US005371909A

United States Patent [19]

McCarty

[11] Patent Number: 5,371,909

[45] Date of Patent: Dec. 13, 1994

[54] BENDABLE PATIENT SUPPORT

[75] Inventor: Read S. McCarty, Hingham, Mass.

[73] Assignee: Children's Medical Ventures, Inc., South Weymouth, Mass.

[21] Appl. No.: 188,791

[22] Filed: Jan. 31, 1994

[51] Int. Cl.[5] ..... A47D 15/00; A47G 9/00

[52] U.S. Cl. ..... 5/655; 5/630; 5/632; 5/490

[58] Field of Search ..... 5/655, 481, 490, 630, 5/632

[56] References Cited

U.S. PATENT DOCUMENTS 3,289,224 12/1966 Witchell ..... 5/481
3,813,148 5/1974 Kraus ..... 297/231
4,783,865 11/1988 Stotler ..... 5/655
5,148,564 9/1992 Reder ..... 5/490

FOREIGN PATENT DOCUMENTS 4237792 5/1993 Germany ..... 5/655

*Primary Examiner*—Alexander Grosz
*Attorney, Agent, or Firm*—James E. Brunton

[57] ABSTRACT

A readily bendable positioning aid, having a soft, spongy foam body for supporting an infant. Once formed into the desired shape, the support maintains its shape until reformed by the user. Disposed internally of the foam body is an elongated, bendable lead rod that weights the body sufficiently so that the support will remain in position about the infant and will effectively constrain movement of the infant.

8 Claims, 1 Drawing Sheet

BENDABLE PATIENT SUPPORT

BACKGROUND OF THE INVENTION

1. Field of the Invention

The present invention relates generally to positioning aids. More particularly, the invention concerns a bendable infant support, having a soft, spongy foam body for supporting a patient such as an infant. Once formed into the desired shape, the support maintains its shape until reformed by the user.

2. Discussion of the Invention

As infants reach an age where they first start to roll over and move about, they can suffer serious injury if they roll off beds or the like, and if they are not otherwise constrained in some manner to a safe location. In the past, makeshift expedients such as pillows, cushions and like articles have been placed around the infant to attempt to constrain the infant to a particular location. Such expedients are unsatisfactory for many reasons, not the least of which is that they can be very dangerous if they shift into a position where the infant's face is covered in a manner to restrict free breathing. Also, such expedients are generally ineffective in constraining unwanted movement of the infant since the supports themselves tend to easily shift.

The unique support of the present invention overcomes the drawbacks of the prior art, makeshift expedients discussed in the preceding paragraph by providing a novel, easily bendable, cushioned support that is weighted to stay in place. The novel support of the present invention includes a soft foam body within which a hermetically sealed, bendable rod is encapsulated. The foam body is covered with a disposable cover, which is, in turn, covered with a soft outer cloth cover which can be removed and washed. The internally disposed, bendable core permits the support to be easily formed into any desired shape so that the soft body portion thereof can be closely formed about the infant. For example, the body can be formed in a manner to surround and support the infant in a side-lying position, or alternatively it can be formed to create a hammock-like support to constrain the infant in a supine position. Due to the novel character of the bendable rod, the body will retain its shape until manually reshaped by the caregiver. The substantial weight of the internally-disposed, bendable rod tends to effectively resist shifting of the support as the patient moves. Because of the novel design of the device it is readily usable with both infants and adults and uniquely provides support to the patient at strategic locations.

SUMMARY OF THE INVENTION

It is an object of the present invention to provide an easily bendable, soft cushioned infant support which can be safely formed about a patient or an infant to provide increased security, comfort and restraint against movement.

Another object of the invention is to provide an infant support of the aforementioned character which is weighted to stay securely in place about the infant.

Another object of the invention is to provide an infant support which is covered first by a disposable cover and then by a soft cloth cover which can be easily removed for washing.

Still another object of the invention is to provide an infant support of the character described in the preceding paragraphs which promotes proper physiologic flexion, facilitates mid-line orientation, improves self-regulation and encourages self-comforting behavior.

Yet another object of the invention is to provide an infant support of the character described, which is easy to use, easy to clean, easy to transport from place to place and is inexpensive to manufacture.

DESCRIPTION OF THE INVENTION

Figure 1:
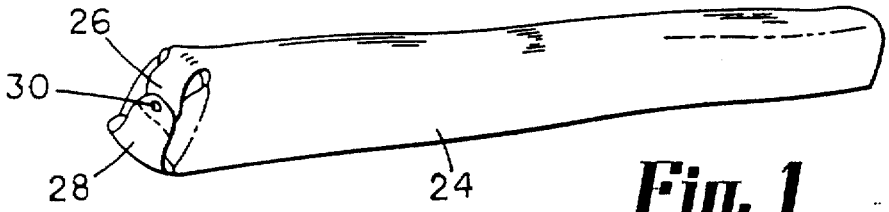
FIG. 1 is a generally perspective view of one form of the positioning aid the present invention.
Figure 2:
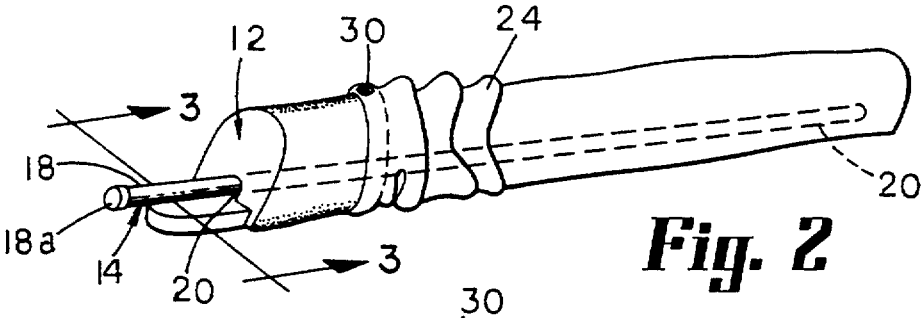
FIG. 2 is a generally perspective view similar to FIG. 1 but showing the outer cover of the device pulled back to expose the bendable rod assembly which is encapsulated within the cushioned body portion of the device.
Figure 3:
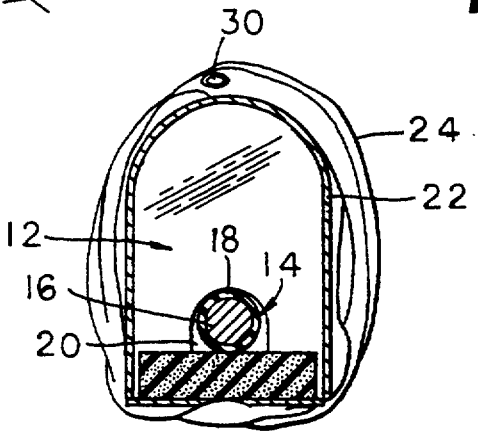
FIG. 3 is a cross-sectional view taken along lines 3—3 of FIG. 2.

Referring to the drawings and particularly to FIGS. 1, 2 and 3, one form of the positioning aid of the present invention is there illustrated and comprises an elongated, yieldably deformable, cushioning portion 12 which is covered by cover means of a character presently to be described. Encapsulated within cushioning portion 12 is a bendable rod assembly generally designated in FIG. 2 by the numeral 14.

As best seen in FIG. 3, bendable rod assembly 14 comprises a bendable rod 16 which is sealably encapsulated within an encapsulating means shown here as an elongated, polyvinyal chloride plastic tube 18. A cap portion 18a closes the outboard end of tube 18 in a manner to hermetically seal rod 16 within the tube. Rod 16 can be constructed of various bendable materials such as metal and plastic, but for purposes of the present invention, lead has proven most satisfactory because of its uniform bending characteristics and its weight, which tends to resist shifting.

As best seen in FIGS. 2 and 3, rod assembly 14 is closely receivable within an elongated, channel-like opening 20 which extends substantially the length of cushioning portion 12. With this construction, assembly 14 can be telescopically inserted into channel 20 to a position wherein it is fully enclosed within the cushioning body of the device. This feature of the invention permits the rod assembly to be reused when it is necessary to replace the cushioning body.

In the present embodiment of the invention, the covering means comprises a first cover in the form of a disposable polyester cover 22 (FIG. 3) which is closely receivable over cushioning portion 12. This cover protects the cushioning body and can be disposed of after each use. Surrounding cover 22 is a second cover, here shown as cloth cover 24. As best seen in FIG. 1, the forward, open end is closable by cooperating flaps 26 and 28 which can be folded over the end of cushioning portion 12 and held securely in a closed position by any type of suitable fastener, such as snap fastener 30. Covering 24, which can be conveniently slipped off of the cushioning body, can be constructed of any suitable material such as cotton or synthetic fiber cloth which can be easily washed by conventional means.

Cushioning portion 12 can be constructed of any suitable soft, spongy material such as natural or synthetic rubber or it can be constructed from a polymeric foam. Suitable polymeric foams can be prepared from virtually any polymer by the introduction of a gas into a polymer matrix to provide a cellular structure of desired consistency. Materials suitable for the construction of cushioning portion 12 are readily commercially available from a number of sources including The Dow Chemical Company.

Figure 4:
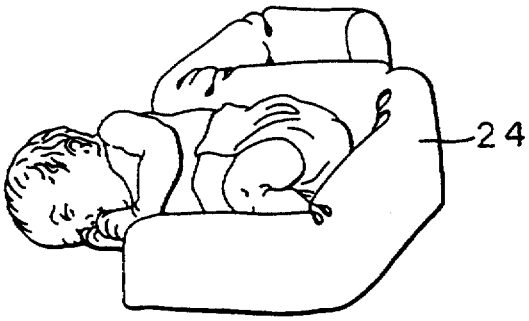
FIG. 4 is a generally diagrammatic view illustrating the positioning aid formed about an infant lying on its side.
Figure 5:
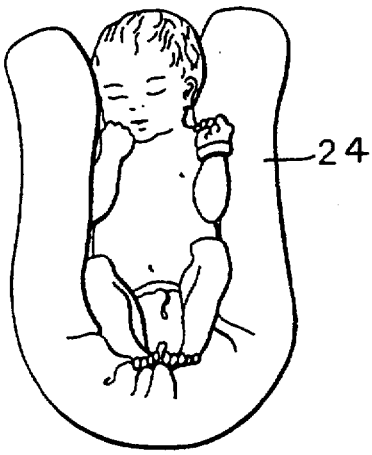
FIG. 5 is a generally diagrammatic view illustrating the positioning aid about an infant disposed in a supine position.

In use, the positioning aid of the invention, can be easily formed into any desired shape, including the shapes shown in FIGS. 4 and 5. Once formed into the desired shape, the positioning aid will retain its shape until reformed by the user. Because of the substantial weight provided by the internally disposed rod assembly, the support will remain in position about the infant and will effectively resist excessive movement.

When the outer cover 24 become soiled, it can be easily removed for washing. If necessary, the inner cover can be removed and discarded. Following replacement of the inner cover, the outer can then be re-positioned about the body in the manner shown in FIG. 1.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A positioning aid comprising:

(a) a yieldably deformable body portion;

(b) cover means for covering said body portion, said cover means comprising first and second coverings;

(c) a bendable member disposed internally of said body portion, said bendable member comprising an elongated lead rod portion; and (d) encapsulating means for sealably encapsulating said bendable member, said encapsulating means comprising a polyvinyl chloride tube.

2. A positioning aid as defined in claim 1 in which said body portion comprises a soft foam rubber.

3. A positioning aid as defined in claim 1 in which said cover means comprises a first disposable cover and a second cloth cover covering said first disposable cover.

4. A formable positioning aid comprising:

(a) an elongated, yieldably deformable foam body portion;

(b) cover means for covering said body portion; said cover means comprising:

(i) a first disposable cover surrounding said body portion; and (ii) a second cloth cover removably surrounding said first cover (c) an elongated, bendable, metal rod disposed internally of said body portion and extending longitudinally thereof; and (d) encapsulating means for encapsulating therewithin said metal rod, said encapsulating means comprising a tube closely surrounding said metal rod.

5. A positioning aid as defined in claim 4 in which said metal rod comprises a lead rod and in which said tube comprises a polyvinyl chloride tube within which said lead rod is sealably encapsulated.

6. A positioning aid as defined in claim 5 in which said form body comprises a polymeric foam.

7. A formable positioning aid, of a length at least sufficient to contact and support a supine infant on its left side, feet and right side, to thereby constrain the infant, comprising:

(a) an elongated, yieldably deformable foam body portion;

(b) a disposable cover surrounding said body portion;

(c) an elongated, bendable, metal rod disposed internally of said body portion and extending longitudinally thereof; and (d) encapsulating means for encapsulating therewithin said metal rod, said encapsulating means comprising a hollow plastic tube closely surrounding said metal rod, said hollow plastic tube comprising an outboard end closed by a cap means, whereby the metal rod is hermetically sealed within the plastic tube.

8. A positioning aid as defined in claim 7 in which said metal rod comprises a lead rod and in which said tube comprises a polyvinyl chloride tube within which said lead rod is sealably encapsulated.

* * * * *